US007985087B2

(12) United States Patent
Li et al.

(10) Patent No.: US 7,985,087 B2
(45) Date of Patent: Jul. 26, 2011

(54) CARD EDGE CONNECTOR WITH IMPROVED RETAINER

(75) Inventors: Zhuang-Xing Li, Kunshan (CN); Xiao-Zhi Fu, Kunshan (CN); Wen-Jun Tang, Kunshan (CN); Xue-Wu Bu, Kunshan (CN)

(73) Assignee: Hon Hai Precision Inc. Co., Ltd., New Taipei (TW)

( * ) Notice: Subject to any disclaimer, the term of this patent is extended or adjusted under 35 U.S.C. 154(b) by 0 days.

(21) Appl. No.: 12/949,788

(22) Filed: Nov. 19, 2010

(65) Prior Publication Data

US 2011/0117768 A1 May 19, 2011

(51) Int. Cl.
*H01R 13/62* (2006.01)

(52) U.S. Cl. ..... 439/157

(58) Field of Classification Search ..... 439/152, 439/153, 157, 160, 372
See application file for complete search history.

(56) References Cited

U.S. PATENT DOCUMENTS 5,634,803 A 6/1997 Cheng et al.
6,431,890 B1 * 8/2002 Li et al. ..... 439/160
7,252,523 B1 * 8/2007 Pennypacker et al. ..... 439/160

* cited by examiner

*Primary Examiner* — Tho D Ta
(74) *Attorney, Agent, or Firm* — Wei Te Chung; Andrew C. Cheng; Ming Chieh Chang

(57) ABSTRACT

A card edge connector for mating with an electronic card includes an elongated housing, a number of contacts and a retainer disposed in the housing. The housing has a center slot extending along a lengthwise direction of the housing and a first tower section at one end thereof. The retainer is rotatably retained in the first tower section and does not extend beyond the first tower along the lengthwise direction, a thickness direction of the housing and a direction opposite to an insertion direction of the electronic card. The retainer has a locker to lock the electronic card and at least a spring sandwiched between the locker and an outer wall of the first tower section to make the locker automatically move in the lengthwise direction in an insertion process of the electronic card.

18 Claims, 9 Drawing Sheets

CARD EDGE CONNECTOR WITH IMPROVED RETAINER

BACKGROUND OF THE INVENTION

1. Field of the Invention

The present invention relates to card edge connectors, more particularly to a card edge connector with an improved retainer.

2. Description of Related Art

Card edge connectors are employed widely in computers to receive a memory card, graphic card, network interface et al. The card edge connector usually has an elongated housing, a plurality of contacts retained in the housing for electrically connecting a corresponding mating card, and a pair of retainers at two ends thereof for locking the mating card. The housing has a pair of side walls, a central slot between the side walls for receiving the mating card, and a pair of tower sections at two ends thereof. Each tower section defines a mounting slot. The retainer is rotatably assembled to the mounting slot and upwardly extends beyond the tower section. The retainer is formed with a locking projection inwardly extending along a lengthwise direction of the housing to lock with the mating card. In an inserting process of the mating card, the retainers can be rotated inwardly to lock with the mating electronic card; while in an ejecting process of the mating electronic card, the retainers can be rotated outwardly to upwardly eject the mating card.

However, with a miniature development trend of electronic device, when said card edge connector is assembled to the electronic device, there is no any more space at two outer sides of the card edge connector to accommodate a pair of hands to rotate the retainers in an insertion or ejecting process of the mating electronic card.

Hence, an improved card edge connector is desired to overcome the above problems.

BRIEF SUMMARY OF THE INVENTION

According to one aspect of the present invention, a card edge connector for mating with an electronic card, comprises: an elongated housing having a pair of opposed side walls, a central slot between the side walls for receiving a lower edge of the electronic card and a first tower section upwardly extending at one end thereof, the first tower section defining a first cavity communicating with the central slot along a lengthwise direction of the housing to receive a side edge of the electronic card, and a groove at outside of the first slot along the lengthwise direction; a plurality of contacts retained to the housing; and a retainer retained in the groove of the first tower section, the retainer having a locker and at least one spring, the locker having a locking section extending into the first cavity, the spring having a first end resisting an outer side of the locker and a second end resisting an inner wall of the groove along the lengthwise direction, which can make the locking projection automatically move back along the lengthwise direction in an insertion process of the electronic card.

According to another aspect of the present invention, a card edge connector for mating with an electronic card, comprises: an elongated housing extending along a lengthwise direction; a center slot extending in the housing along said lengthwise direction; a plurality of contacts disposed in the housing and located by two sides of the center slot; a first tower section located at one end of the housing; and a retainer rotatably retained in the first tower section and not extending beyond the first tower along the lengthwise direction, a thickness direction of the housing and a direction opposite to an insertion direction of the electronic card, the retainer having a locker to lock the electronic card and at least one spring sandwiched between the locker and an outer wall of the first tower section to make the locker automatically move back along the lengthwise direction in an insertion process of the electronic card.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
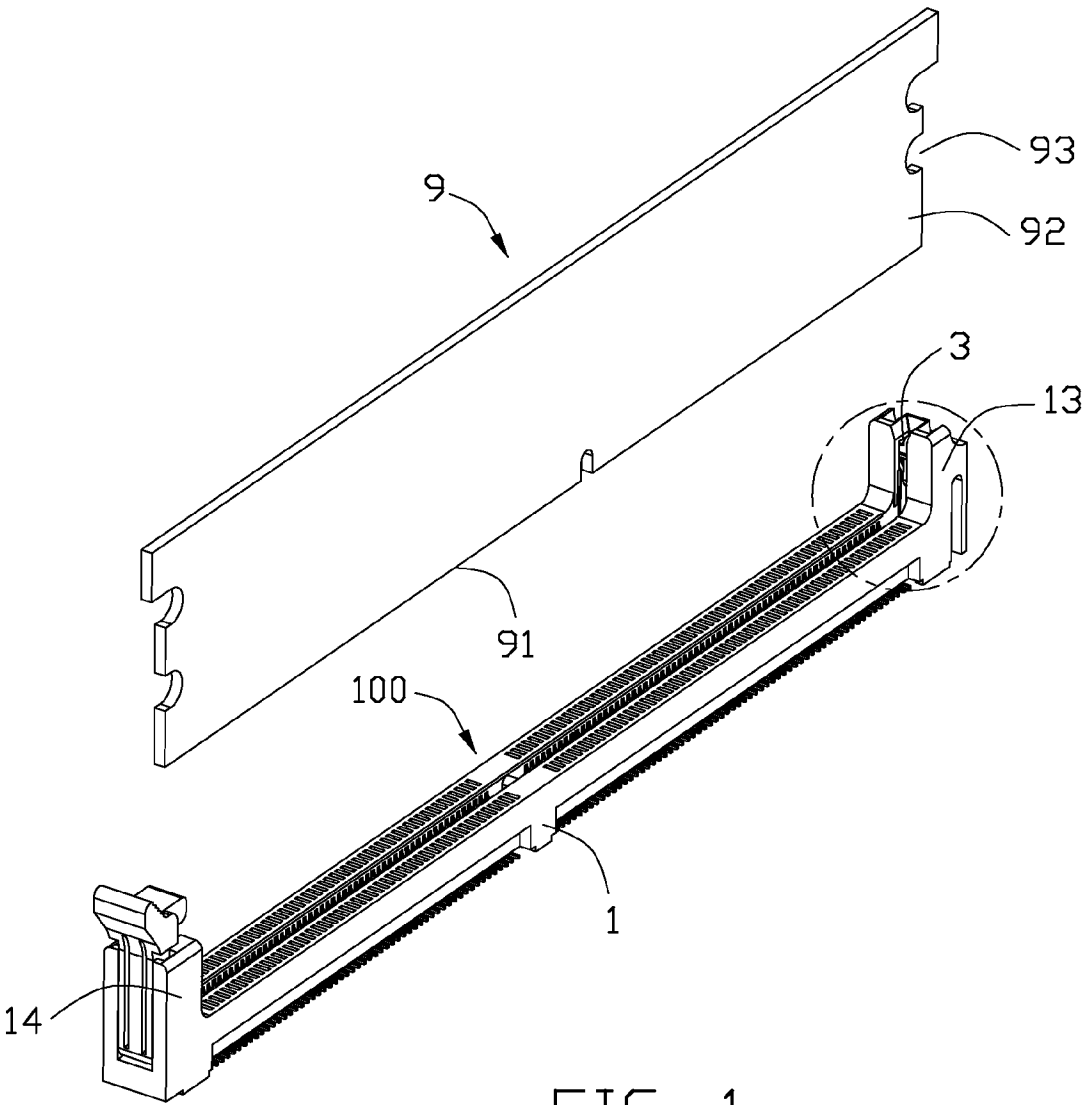
FIG. 1 is a perspective view of a card edge connector according to the present invention and a mating electronic card.
Figure 2:
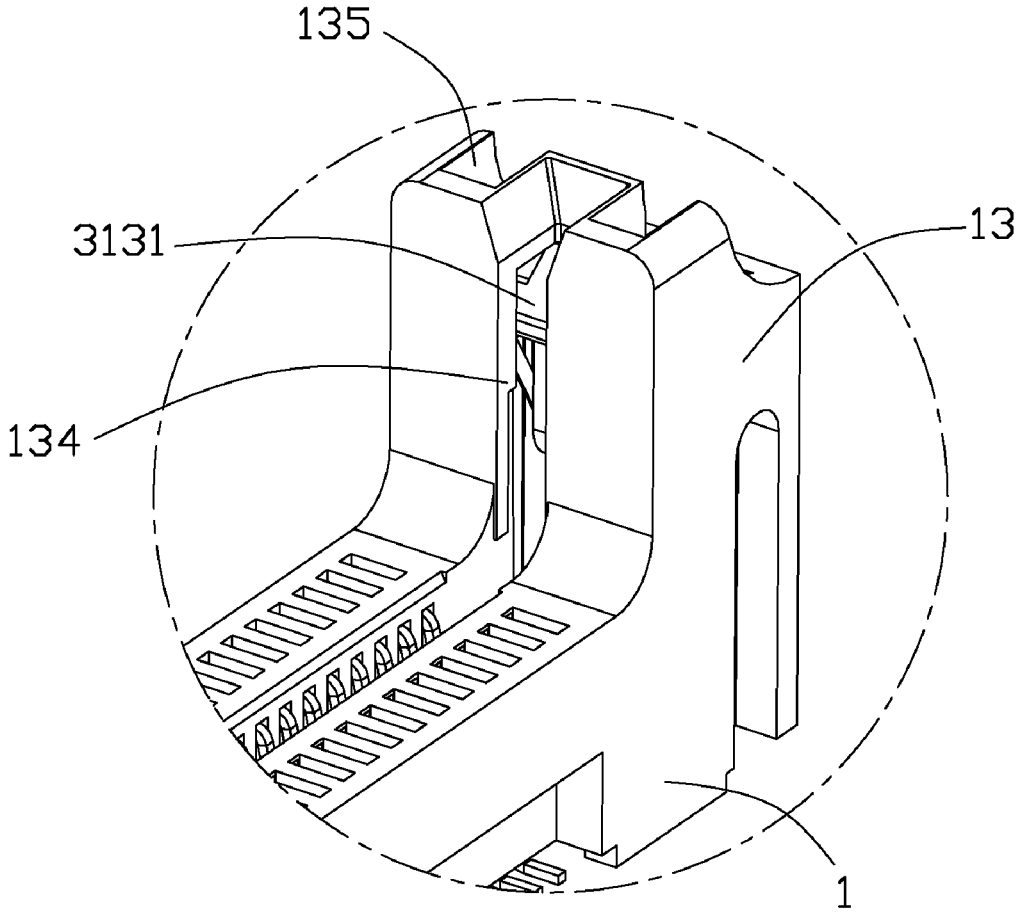
FIG. 2 is a partly enlarged view of the card edge connector shown in FIG. 1.
Figure 3:
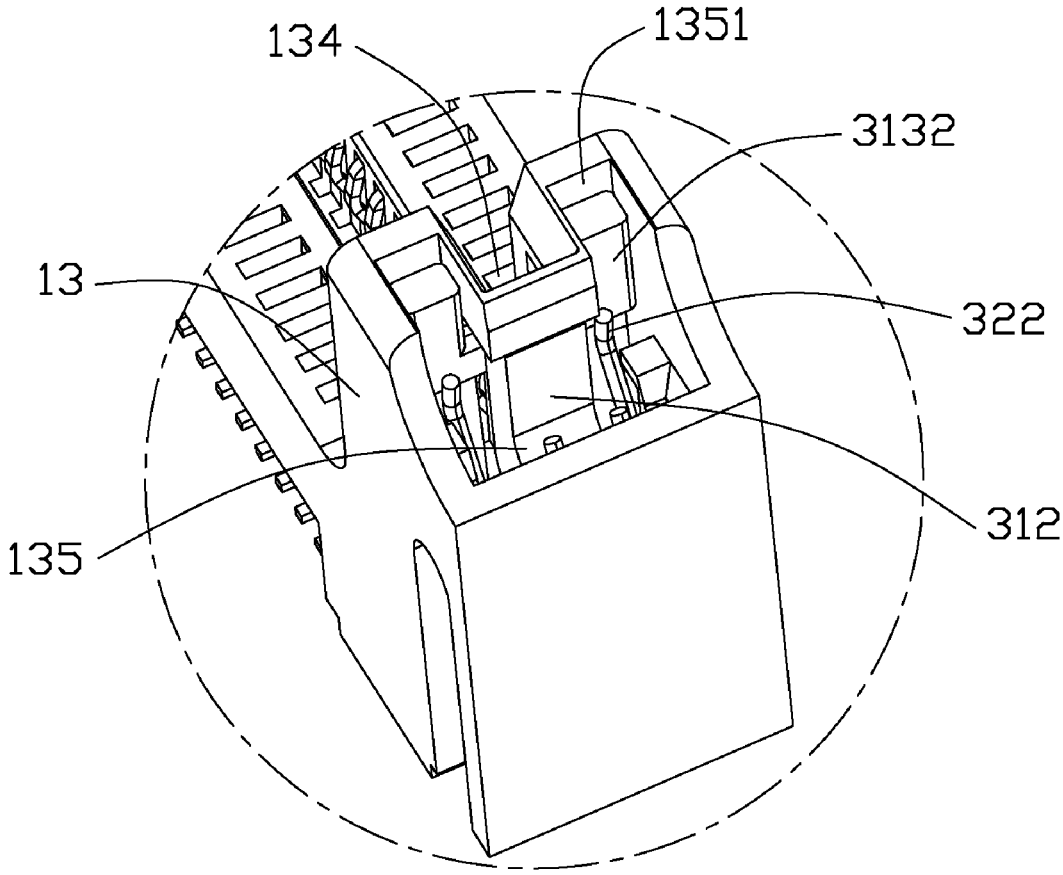
FIG. 3 is a view similar to FIG. 2, while taken from a different aspect.
Figure 4:
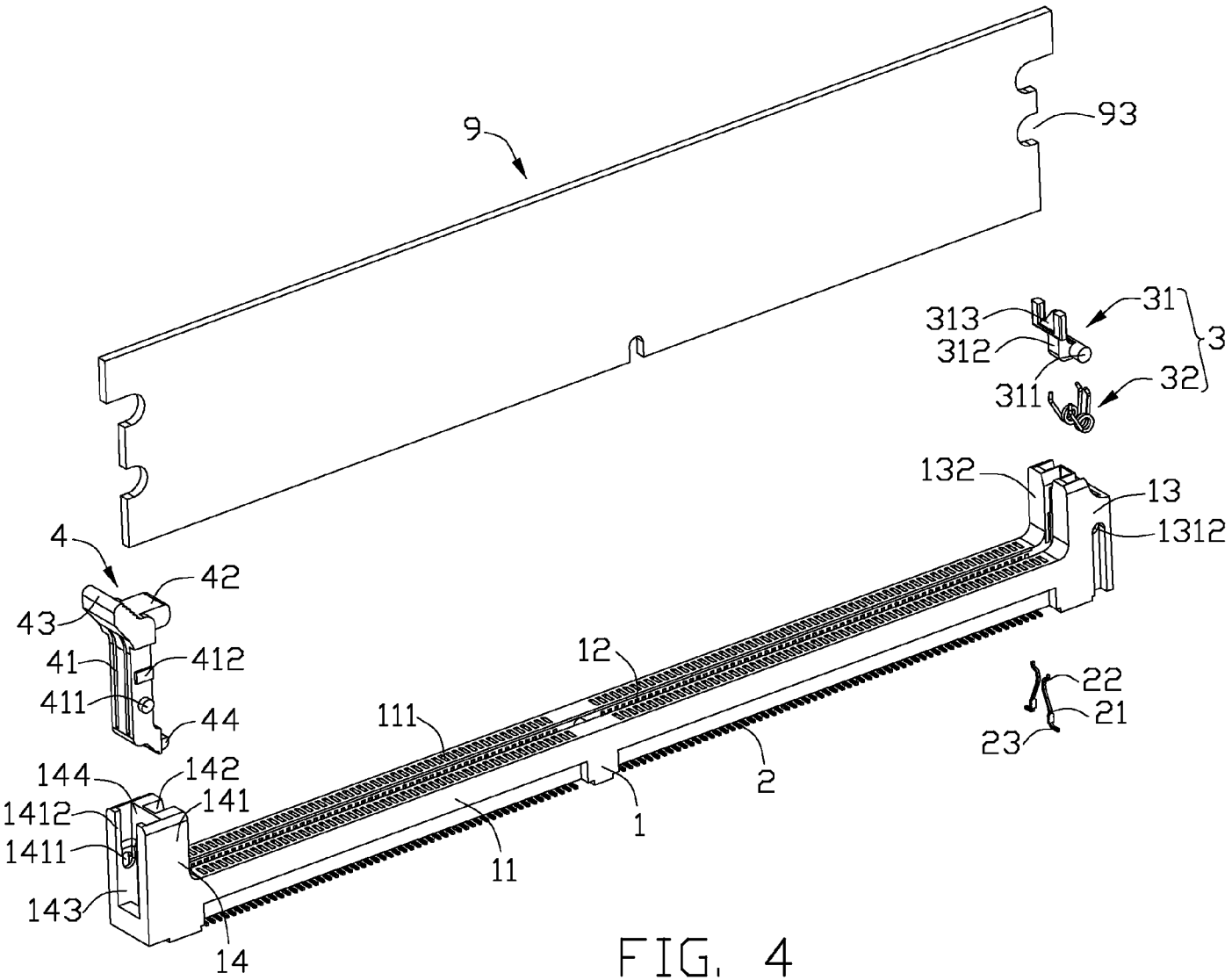
FIG. 4 is a partly exploded view of the card edge connector and the electronic card shown in FIG. 1.
Figure 5:
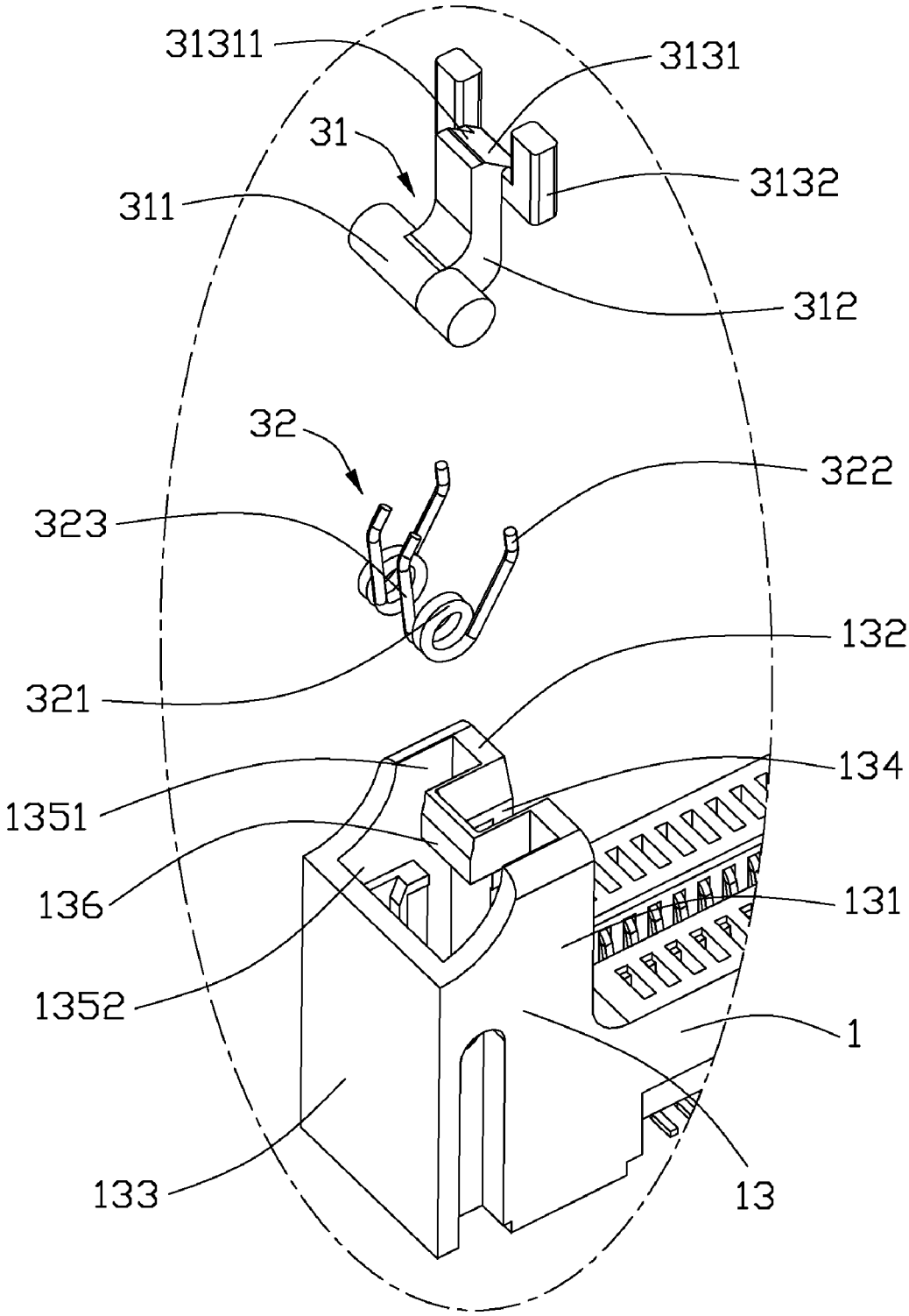
FIG. 5 is a partly exploded view of one part of the card edge connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-7, a card edge connector 100 for mating with a mating electronic card 9 according to the present invention is disclosed. The card edge connector 100 comprises an elongated housing 1, a plurality of contacts 2 retained in the housing 1, and a retainer 3 and an ejector 4 attached to opposite two ends of the housing 1 to lock with the electronic card 9. The electronic card 9 has a lower edge 91 with a plurality of metal fingers (not shown) to electrically connect with the contacts 2, and a pair of side edges 92 at two sides thereof. Each side edge 92 defines at least one notch 93 to lock with the card edge connector 100.

Referring to FIGS. 2-5, the housing 1 has a pair of side walls 11 extending along a lengthwise direction of the housing 1, a central slot 12 between the side walls 11 and extending along said lengthwise direction, a first tower section 13 and a second tower section 14 respectively extending upwardly from opposite two ends of the housing 1. Each side wall 11 defines a plurality of passageways 111 extending therethrough along an insertion direction of the electronic card 9. The passagewarys 111 communicate with the central slot 12 along a thickness direction perpendicular to the lengthwise direction of the housing 1 and the insertion direction of the electronic card 9.

The first tower section 13 has a pair of first arms 131 upwardly extending from the side walls 11, a first wall 132 located at an inner side thereof and connecting inner ends of the first arms 131, and a second wall 133 located at an outer side thereof and connecting outer ends of the first arms 131. The first wall 131 is also an inner wall of the first tower section 13, and the second wall 133 is also an outer wall of the first tower section. The first wall 132 is parallel to the second wall 133, and perpendicular to the first arms 131. The first tower section 13 defines a first cavity 134 recessed from the first wall 132 along the lengthwise direction to receive one side edge 92 of the electronic card 9, a groove 135 recessed from a top end thereof to receive the retainer 3, and a third wall 136 between the first cavity 134 and the groove 135. The third wall 136 is parallel to the first and second walls 132, 133. The first cavity 134 communicates with the central slot 12 along the lengthwise direction, and communicates with the groove 135 at a lower side of the third wall 136 along the lengthwise direction.

The groove 135 present as U-shape and has a pair of first grooves 1351 at two sides of the first cavity 134 along the thickness direction, and a second groove 1352 between the third wall 136 and the second wall 133 along the lengthwise direction. The first grooves 1351 extend along the lengthwise direction and communicate with the second groove 1352 along the lengthwise direction. The third wall 136 is formed with an oblique plane at a top end thereof to guide the electronic card 9 being inserted into the first cavity 134. Each first arm 131 defines a first axle hole 1312 which communicates with the second groove 1352.

The second tower section 14 is opposed to the first tower section 13, and has a pair of second arms 141 respectively extending upwardly from the side walls 11, a second cavity 142 at an inner side thereof to receive another side edge 92 of the electronic card 9, a receiving space 143 at an outer side thereof to receive the ejector 4, and a fourth wall 144 between the second cavity 142 and the receiving space 143. The receiving space 143 communicates with the second cavity 142 at a lower side of the fourth wall 144. The second arms 141 each has a second axle hole 1411 to retain the ejector 4 and a fixing protrusion 1412 at an upper side of the axle hole 1411 to fix the ejector 4. The ejector 4 is rotatably received in the receiving space 143 and upwardly extends beyond a top end of the second tower section 14. The ejector 4 has a body portion 41, a locking portion 42 and an operating portion 43 oppositely extending from a top end of the body portion 41 along the lengthwise direction, and a kicker 44 inwardly extending to the second cavity 143 from a lower end of the body portion 41. The body portion 41 is formed with a pair of first pivots 411 outwardly extending from two sides thereof to engage with the second axle holes 1411, and a pair of latch protrusions 412 outwardly extending from two sides thereof to lock with the fixing protrusions 1412. The latch protrusions 412 are located at an upper side of the first pivots 411.

Each contact 2 has a securing portion 21 retained in the passageways 111, a contact portion 22 protruding into the central slot 112 from the securing portion 21, and a tail portion 23 downwardly extending out of the housing 1 from a lower end of the securing portion 21.

The retainer 3 is received in the groove 135 and does not extend beyond the first tower section 13 along the lengthwise direction, the thickness direction, and a direction opposite to the insertion direction of the electronic card 9 to prevent the retainer 3 from being hit to release the electronic card 9. The retainer 3 comprises a locker 31 and a pair of springs 32 fixing on the locker 31. The locker 31 has a second pivot 311 extending along the thickness direction at a lower side thereof, a connecting portion 312 inwardly and upwardly extending from a middle position of the second pivot 311, and a locking section 313 inwardly extending from a top end of the connecting portion 312 along the lengthwise direction. Two sides of the second pivot 311 engage with the first axle holes 1312 respectively and can rotate in the first axle holes 1312.

The locking section 313 has a locking projection 3131 inwardly extending into the first cavity 134 along the lengthwise direction, and a pair of blocks 3132 outwardly and upwardly extending from two sides of the locking projection 3131 along the thickness direction. The locking projection 3131 is located below the third wall 136 and can move between the first cavity 134 and the second groove 1352 along the lengthwise direction. The locking projection 3131 is formed with an oblique guiding face 31311 at an upper and inner side thereof to guide the electronic card 9 being inserted into the first cavity 134. Each block 3132 defines an inner surface which is located at a common plane with that of the locking projection 3131. The blocks 3132 are received in the first grooves 1351 and can move in the first groove 1351 along the lengthwise direction. The inner surfaces of the blocks 3132 resist an outer side of the first wall 132 for preventing the retainer 3 from overly rotating inwardly.

The springs 32 are two torsion springs respectively ringing on two sides of the second pivot 311 in the present invention. Each spring 32 has a torsion portion 321 ringing on the pivot 311, a first end 322 and a second end 323 respectively extending upwardly from two sides of the torsion portion 321. The first end 322 resists an outer side of the block 3132 along the lengthwise direction. The second end 323 resists an inner side of the second wall 133 along the lengthwise direction, and the inner side of the second wall 133 is also a rear inner wall of the groove 135 along the lengthwise direction.

Figure 6:
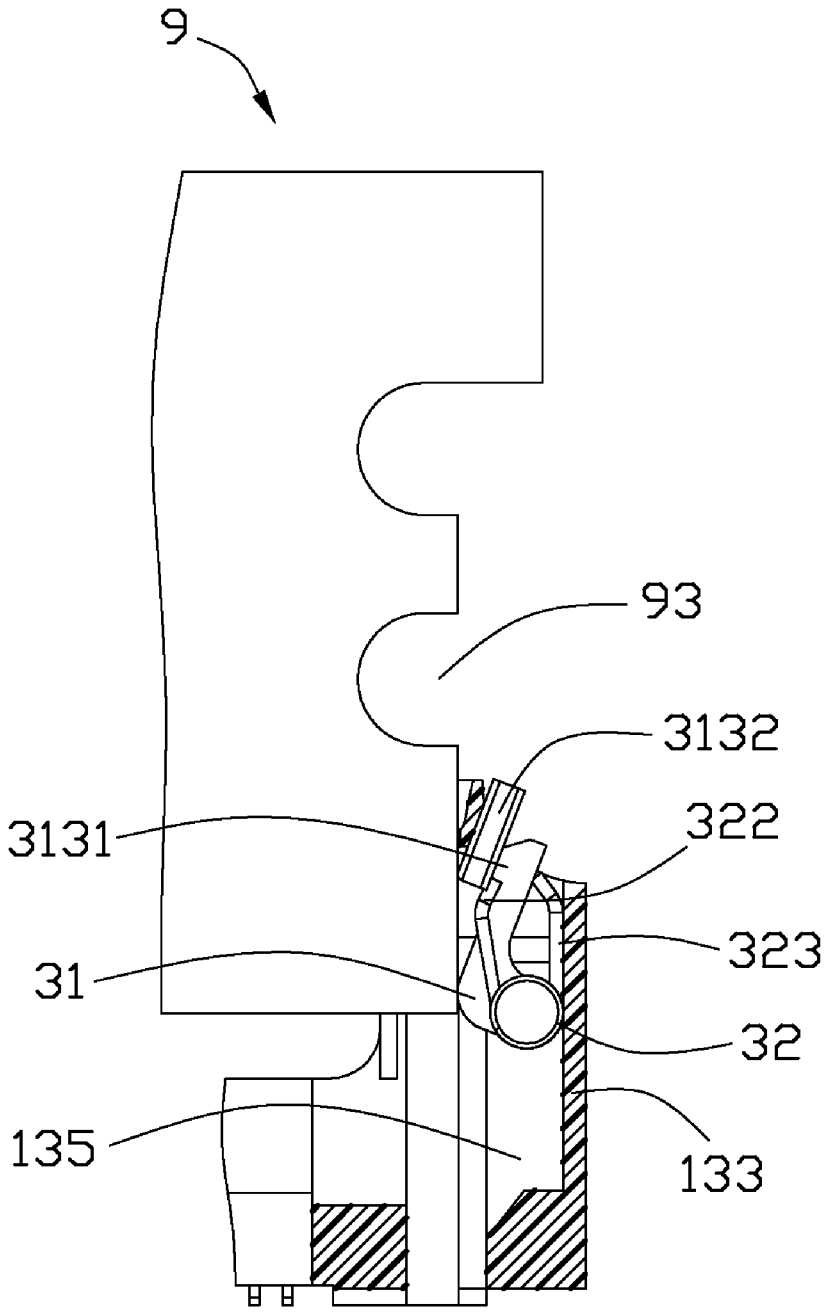
FIG. 6 is a cut-away view of the card edge connector and the electronic card to show the electronic card is being inserted into the card edge connector.
Figure 7:
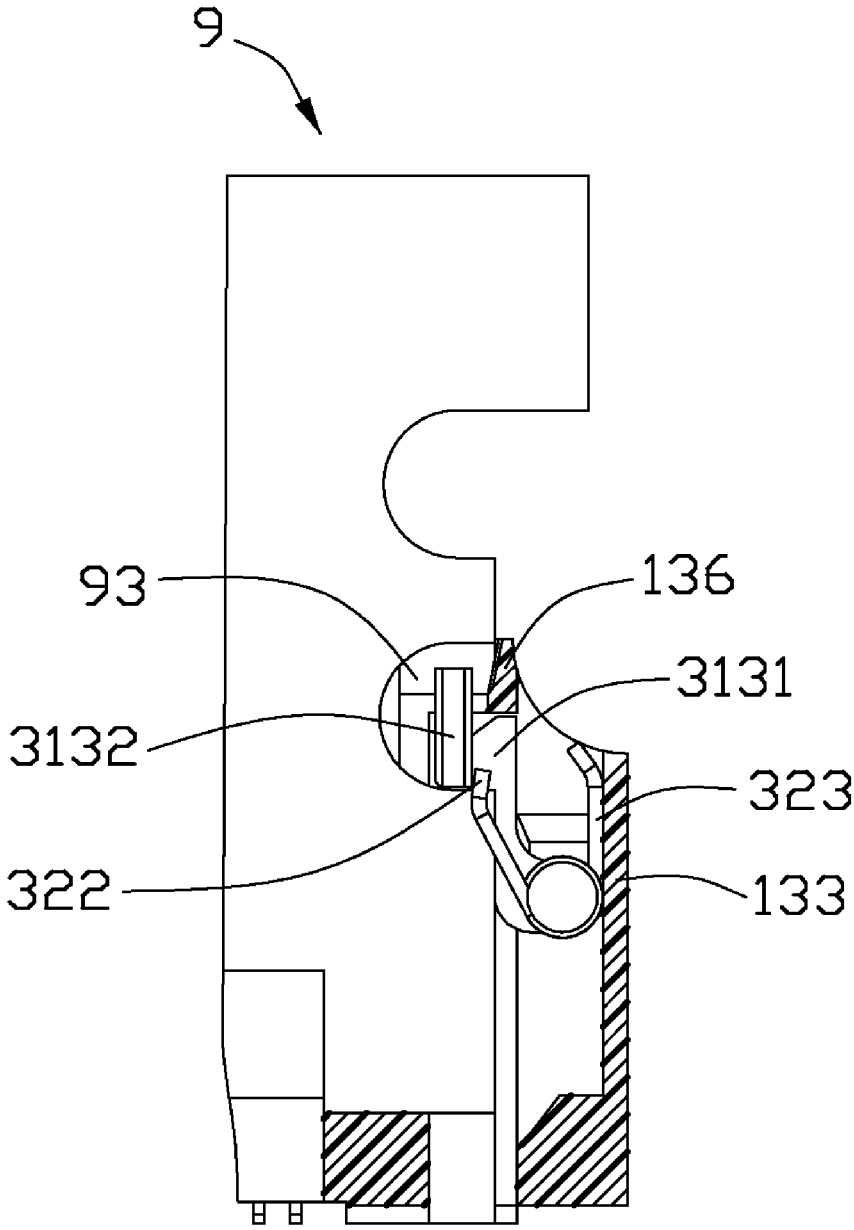
FIG. 7 is another cut-away view of the card edge connector and the electronic card to show the electronic card has been fully inserted into the card edge connector.

Referring to FIGS. 6 and 7, in an insertion process of the electronic card 9, the electronic card 9 moves downwardly along the oblique guiding face 31311 and resists the locking projection 3131 outwardly; then the locker 31 is resisted to rotate along a clockwise direction and moves out of the first cavity 134; at the same time, the springs 32 are pressed outwardly, and a lower end of the side edge 92 presses the kicker 44 of the ejector 4 to make the ejector 4 rotate along the clockwise direction; when the electronic card 9 is fully inserted into the central slot 12 and the first and second cavities 134, 142, the springs 32 rebound to push the locker 31 moving along an anticlockwise direction, then the locking projection 3131 moves into the first cavity 134 and locks with the notch 93 of one side edge 92 of the electronic card 9, and the blocks 3132 resist the first wall 132 to prevent the retainer 3 from overly moving along the anticlockwise direction; at the same time, the locking portion 42 of the ejector 4 moves into the notch 93 of another side edge 92 of the electronic card 9 for preventing the electronic card 9 from moving along the insertion direction, and the latch protrusions 412 lock with the fixing protrusions 1412 to secure the ejector 4 in the receiving space 143.

In a withdrawn process of the electronic card 9, firstly, pressing the operating portion 43 to make the ejector 4 move along the anticlockwise direction, then the kicker 44 pushes the lower end of the side edge 92 upwardly; secondly, pulling the electronic card 9 out of the card edge connector 100 along an oblique direction.

Figure 8:
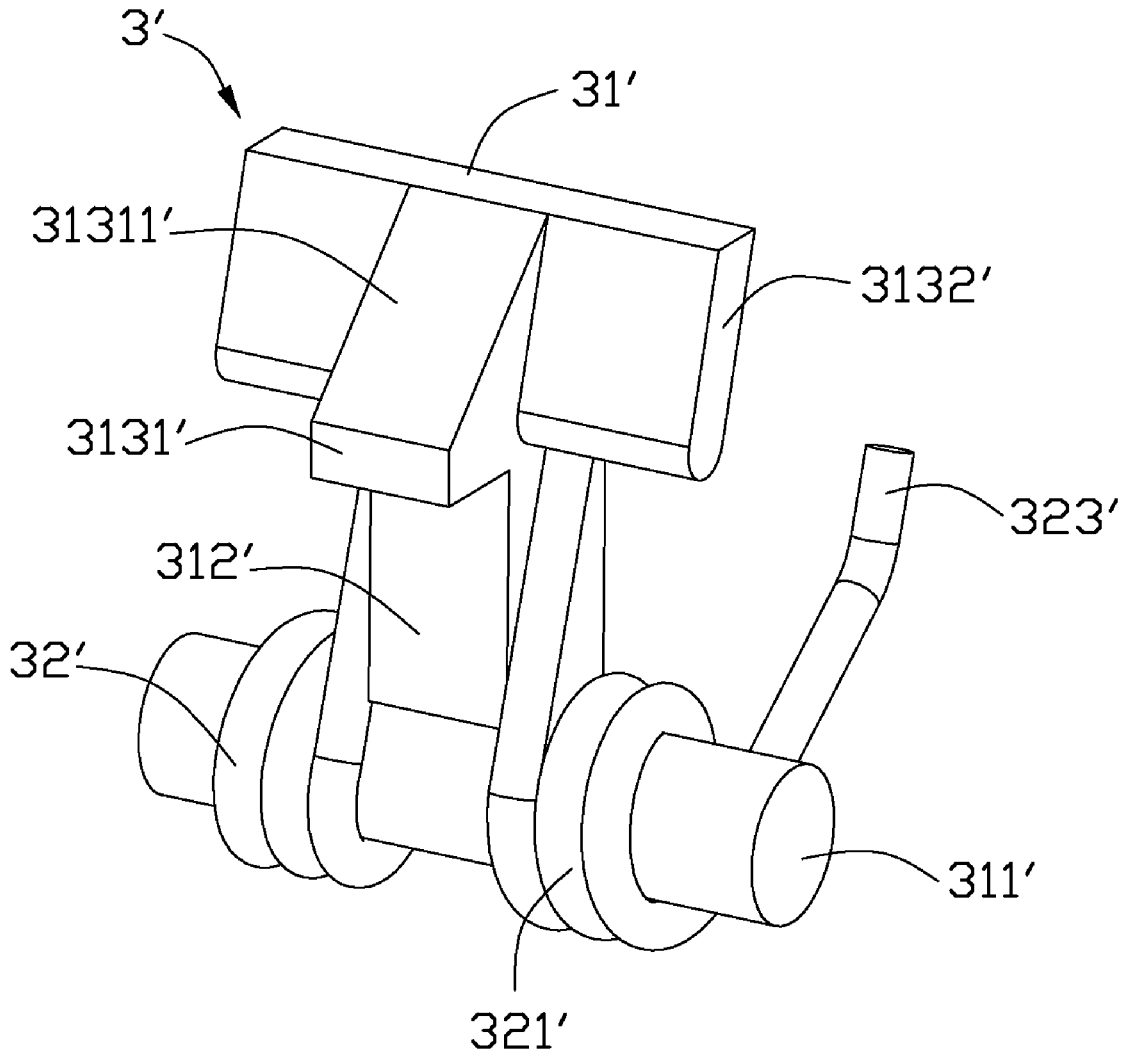
FIG. 8 is a perspective view of an alternative retainer of the card edge connector.
Figure 9:
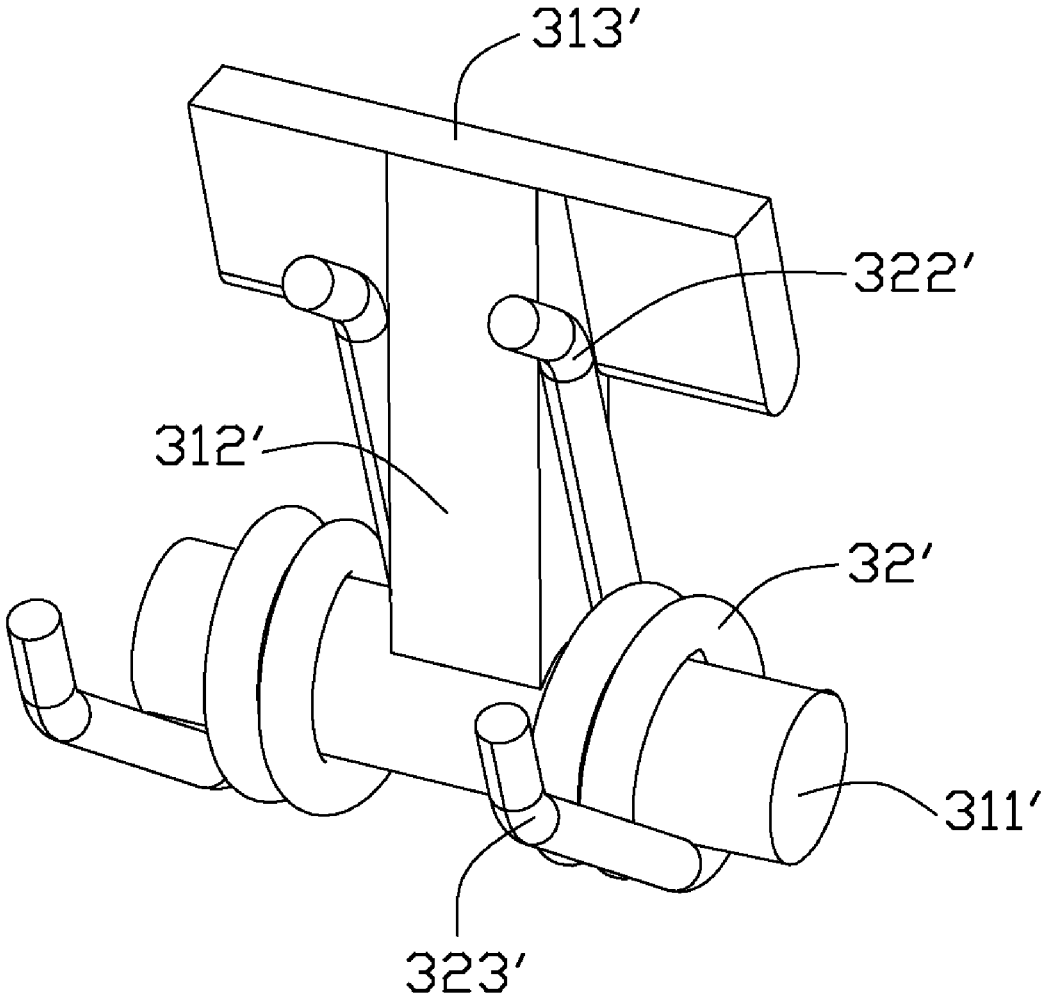
FIG. 9 is a view similar to FIG. 8, while taken from a different aspect.

Referring to FIGS. 8 and 9, an alternative retainer 3' of the card edge connector 100 is disclosed. The retainer 3' also comprises a locker 31' and a pair of springs 32' ringing on the locker 31'. The locker 31' has a second pivot 311' extending along the thickness direction at a lower side thereof, a connecting portion 312' inwardly and upwardly extending from a middle position of the second pivot 311', and a locking section 313' inwardly extending from a top end of the connecting portion 312' along the lengthwise direction. Two sides of the second pivot 311' engage with the first axle holes 1312 respectively and can rotate in the first axle holes 1312.

The locking section 313' has a locking projection 3131' inwardly extending into the first cavity 134' along the lengthwise direction, and a pair of blocks 3132' outwardly extending from two sides of the locking projection 3131' along the thickness direction. The locking projection 3131' is located at a lower side of the third wall 136, and formed with an oblique guiding face 31311' at an upper and inner side thereof to guide the electronic card 9 being inserted into the first cavity 134. The blocks 3132' define an inner surface which is located at an outer side of an inner surface of the locking projection 3131' along the lengthwise direction, at this time, a thicker first wall which is same to the first wall 132 being full of the first grooves 1351 on a housing (not shown) retained with the retainer 3' is chosen to ward off the blocks 3132'. The inner surfaces of the blocks 3132' resist an outer side of the thicker first wall for preventing the retainer 3' from overly rotating inwardly.

The springs 32' are same to the springs 32, and has a torsion portion 321', a first end 322' and a second end 323' respectively extending upwardly from two sides of the torsion portion 321'. The first end 322' resists an outer side of the block 3132' along the lengthwise direction. The second end 323' resists an inner side of the second wall 133' along the lengthwise direction.

As fully described above, the retainer 3, 3' can automatically move back to lock the electronic card 9 in the insertion direction of the electronic card 9, which does not need to be operated by two hands (not shown) and is convenient to be used; besides, the retainer 3, 3' is received in the groove 135 and does not extend beyond the first tower section 13 in an active process thereof, thereby the retainer 3, 3' does not occupy any more space at one outside of the card edge connector 100 along the length direction, which can save up an inner space of an electronic device (not shown) for adapting a miniature development trend. In addition, the retainer 3, 3' consist of a locker 31, 31' and a spring 32, 32' and has a simple structure to be manufactured conveniently.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for mating with an electronic card, comprising:

an elongated housing having a pair of opposed side walls, a central slot between the side walls for receiving a lower edge of the electronic card and a first tower section upwardly extending at one end thereof, the first tower section defining a first cavity communicating with the central slot along a lengthwise direction of the housing to receive a side edge of the electronic card, and a groove at outside of the first cavity along the lengthwise direction;

a plurality of contacts retained to the housing; and a retainer retained in the groove of the first tower section, the retainer having a locker and at least one spring, the locker having a locking section extending into the first cavity, the spring having a first end resisting an outer side of the locker and a second end resisting an inner wall of the groove along the lengthwise direction, which can make the locking section automatically move back along the lengthwise direction in an insertion process of the electronic card;

wherein the retainer is fully received in the groove and does not extend beyond the first tower section along both the lengthwise direction and a direction opposite to the insertion direction of electronic card.

2. The card edge connector as claimed in claim 1, wherein the spring is a torsion spring, the locker has a pivot rotatably retained on the first tower section, the spring has a torsion portion ringing on the pivot, and the first and second ends upwardly extend from two sides of the torsion portion.

3. The card edge connector as claimed in claim 1, wherein the housing has a second tower section upwardly extending from another end thereof, and the card edge connector further comprises an ejector rotatably retained in the second tower section and extends beyond a top end of the second tower section.

4. The card edge connector as claimed in claim 1, wherein the locking section has a locking projection projecting into the first cavity to lock with the electronic card, and a pair of blocks outwardly extending from two sides of the locking projection along a thickness direction perpendicular to the lengthwise direction of the housing, and the first end resists an outer side of the blocks.

5. The card edge connector as claimed in claim 4, wherein the locking projection is formed with an oblique guiding face at an upper and inner side thereof to guide the electronic card being inserted into the first cavity.

6. The card edge connector as claimed in claim 4, wherein the block defines an inner surface which is located at a common plane with that of the locking projection along the lengthwise direction.

7. The card edge connector as claimed in claim 4, wherein the block defines an inner surface which is located at an outer side of an inner surface of the locking projection along the lengthwise direction.

8. The card edge connector as claimed in claim 4, wherein the first tower section has a first wall at an inner side thereof, a second wall at an outer side thereof, and a third wall between the first cavity and the groove along the lengthwise direction, and the blocks are received in the groove and resist an outer side of the second wall to prevent the locker from overly rotating along an anticlockwise direction.

9. The card edge connector as claimed in claim 8, wherein the first cavity communicates with the groove at a lower side of the third wall, and the locking projection is located below the third wall and can move between the first cavity and the groove along the lengthwise direction.

10. A card edge connector for mating with an electronic card, comprising:

an elongated housing extending along a lengthwise direction;

a center slot extending in the housing along said lengthwise direction;

a plurality of contacts disposed in the housing and located by two sides of the center slot;

a first tower section located at one end of the housing; and a retainer rotatably retained in the first tower section and not extending beyond the first tower along the lengthwise direction, a thickness direction of the housing and a direction opposite to an insertion direction of the electronic card, the retainer having a locker to lock the electronic card and at least one spring sandwiched between the locker and an outer wall of the first tower section to make the locker automatically move back along the lengthwise direction in an insertion process of the electronic card.

11. The card edge connector as claimed in claim 10, wherein the first tower section defines a first cavity at an inner side thereof to receive a side edge of the electronic card, a groove at an outer side of the first cavity and a third wall between the first cavity and the groove along the lengthwise direction, the retainer is received in the groove and protrudes into the first cavity along the lengthwise direction.

12. The card edge connector as claimed in claim 11, wherein the locker having a pivot rotatably retained in the first tower section, a locking projection located below the third wall and protruding into the first cavity to lock with the electronic card, and at least one block at one side of the locking projection to resist on a front inner wall of the groove.

13. The card edge connector as claimed in claim 12, wherein the spring has a torsion portion ringing on the pivot, and a first end and a second end respectively extending from two sides of the torsion portion, and the first end resists an outer side of the block, and the second end resists the outer wall of the first tower section.

14. A card edge connector for retaining a memory module therein, comprising:

an elongated insulative housing defining a central slot along a longitudinal direction thereof with a pair of towers at two opposite ends of the housing in said longitudinal direction;

a plurality of contacts disposed by two sides of the central slot;

each of said towers defining a cavity facing toward the central slot and upwardly communicating with an exterior for allowing downward insertion of the memory module into the central slot with a side edge region of the memory module held in the cavity; and a retainer mounted within one of the towers and including a locker equipped with a locking lug thereof and pivotally moveable relative to the corresponding tower about an pivot axis which extends in a transverse direction perpendicular to said longitudinal direction, and a biasing device constantly urging said locker toward the central slot in said longitudinal direction; wherein when said locker is moved to an inner locking position, the locking lug is overlapped with the central slot in a top view for locking into a notch formed in the side edge region of memory module;

wherein the cavity is formed by a U-shaped structure of the tower, and the locking lug is located under said U-shaped structure in a vertical direction perpendicular to both said longitudinal direction and said transverse direction, when said locker is at the inner locking position.

15. The card edge connector as claimed in claim 14, wherein said locker is essentially hidden wholly in the tower.

16. The card edge connector as claimed in claim 15, wherein said locker is equipped without any manual operation handle at a top portion thereof and is not expected to be manually operated.

17. The card edge connector as claimed in claim 14, wherein said locker is dimension to be short enough for not extending beyond the housing in the longitudinal direction when the locker is rotated to an outermost unlocking position.

18. The card edge connector as claimed in claim 17, wherein an ejector is pivotally located in the other of the towers and includes an upper handle with a locker therewith and a lower kicker for locking and manually ejecting the memory module.

* * * * *